United States Patent [19]

Traut

[11] 4,264,805

[45] Apr. 28, 1981

[54] WIREFORM HEATING ELEMENT SUPPORT FOR CERAMIC TOP

[75] Inventor: Bernard P. Traut, Buffalo, Minn.

[73] Assignee: Litton Systems, Inc., Beverly Hills, Calif.

[21] Appl. No.: 98,683

[22] Filed: Nov. 29, 1979

[51] Int. Cl.[3] ..... H05B 3/68

[52] U.S. Cl. ..... 219/464; 219/357; 219/458; 219/463; 219/467

[58] Field of Search ..... 219/402, 403, 436, 458, 219/463–465, 467, 520, 532, 536, 537, 542, 546, 447, 351, 355, 357, 345, 446, 476, 480; 338/304, 306, 315–318; 267/103, 101, 105, 107, 108, 109, 110, 111, 144, 160, 165

[56] References Cited

U.S. PATENT DOCUMENTS

| | | | |
|---|---|---|---|
| 2,278,994 | 4/1942 | Kempton | 219/546 |
| 2,478,809 | 8/1949 | Deal | 338/317 |
| 2,824,204 | 2/1958 | Reno et al. | 219/403 |
| 2,826,669 | 3/1958 | Schmertz | 219/357 |
| 3,613,177 | 10/1971 | Davis | 219/463 |
| 3,909,592 | 9/1975 | Eide | 219/464 |

FOREIGN PATENT DOCUMENTS

| | | | |
|---|---|---|---|
| 175294 | 2/1935 | Switzerland | 219/520 |
| 655947 | 8/1951 | United Kingdom | 219/357 |

OTHER PUBLICATIONS

IBM Tech. Disclosure Bulletin, vol. 19, No. 10, Mar. 1977, Lamp Mounting Spring, Smeins, p. 3658.

*Primary Examiner*—Elliot A. Goldberg
*Assistant Examiner*—Bernard Roskoski
*Attorney, Agent, or Firm*—Robert E. Lowe; Nate F. Scarpelli

[57] ABSTRACT

Apparatus for supporting electric range heating elements below a smooth cooking surface, including a lightweight wire frame formed with at least a pair of resilient wire members for capturing and resiliently maintaining a heating element between the wire members and the bottom of the cooking surface. A pair of resilient wire members each comprising an undulating wireform extends across the wire frame with at least one heating element being captured and maintained in position between the cooking surface and the pair of undulating wireform members. A plurality of clips lockingly engage the conventional range top frame with another clip end engaging the lightweight wire frame to form an assembly of the range top frame, the cooking surface and the lightweight wire frame with the heating elements captured between the wire frame and the cooking surface. In another embodiment, the wire frame extending around the perimeter of the cooking surface comprises an undulating wireform.

10 Claims, 9 Drawing Figures

WIREFORM HEATING ELEMENT SUPPORT FOR CERAMIC TOP

This invention relates to electric ranges and in particular to improved apparatus for supporting the electric range heating elements.

BACKGROUND OF THE INVENTION

Within the past few years, an electric range having a smooth, planar cooking surface has become increasingly popular. In such a range, the smooth cooking surface is formed of a glass or ceramic sheet with the electric heating elements mounted on the underside of the cooking surface. In order to prevent any substantial losses in heating efficiency, the heating elements must be mounted immediately adjacent the cooking surface and rigidly maintained in positioned. Any lateral movement of the heating element would undesirably misalign the heating element with the cooking vessel placed on the top of the cooking surface. In addition, since the radiated heat inversely varies by the square root of the distance between the heating element and the cooking surface, the heating element must be rigidly clamped to the cooking surface in order to avoid wasting electric energy during the cooking process.

In the past these requirements have made it necessary to employ rather rigid, metal box frames with rivets, etc. to maintain the heating elements aligned in position and rigidly beneath the cooking surface. The prior box-type frame consisted of many individual parts all of which had to be assembled and riveted in position in a time consuming procedure during construction of the range. Thus, it is desired to reduce the number and weight of parts required as well as the assembly time, while also meeting the necessity to maintain the accurate and rigid location of the heating elements with respect to the cooking surface.

SUMMARY OF THE INVENTION

In accordance with the principles of the present invention, there is provided a lightweight wire frame formed with at least a pair of resilient wire members for capturing and resiliently maintaining a heating element between the wire members and the bottom of the cooking surface. In the preferred embodiment of the invention, the wire frame extends around the perimeter of and immediately below the cooking surface. A pair of resilient wire members each comprising an undulating wireform extends across the wire frame with at least one heating element being captured and maintained in position between the cooking surface and the pair of undulating wire-form members. A plurality of clips lockingly engage the conventional range top frame with another clip end engaging the lightweight wire frame to form an assembly of the range top frame, the cooking surface and the lightweight wire frame with the heating elements captured between the wire frame and the cooking surface.

In another embodiment, the wire frame extending around the perimeter of the cooking surface comprises an undulating wireform. In either embodiment, the wire elements required are less than half that required with the prior metal box type frame, and the assembly time is significantly reduced. In addition, the weight of the elements has been significantly reduced.

DETAILED DESCRIPTION

Figure 1:
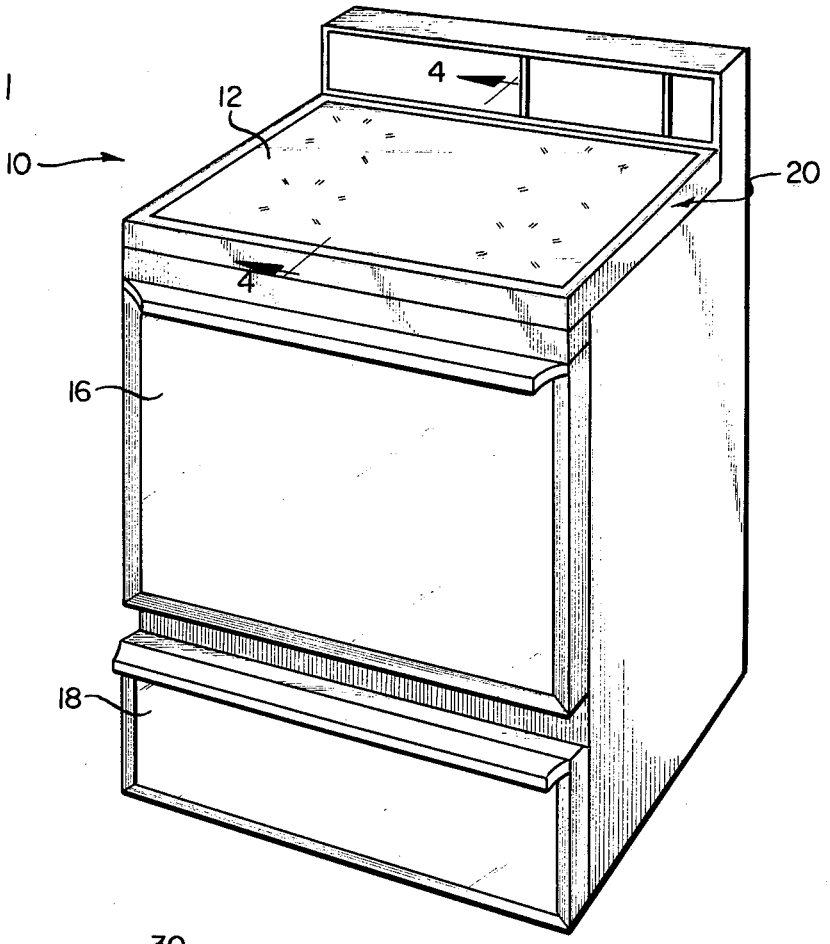
FIG. 1 is a perspective view illustrating an electric range having a flat top cooking surface with the electric heating elements mounted therebeneath.

Referring now to FIG. 1 there is illustrated an electric range 10 of the type having electric heating elements mounted beneath a flat top cooking surface 12. The cooking surface 12 is normally formed of a ceramic or glass sheet having indicia 14 noting the location of the heating elements mounted beneath the cooking surface. This of course readily enables the user to align a cooking utensil with the heating elements to insure cooking efficiency. The range or cooking stove may also include an oven 16 and a storage portion 18, however it is to be understood that the present invention is only concerned with the range top heater element assembly 20.

Reference may now be made to FIGS. 2 through 6 wherein there is illustrated a preferred embodiment of the range top heater element assembly 20 in accordance with the principles of the present invention. As can be seen most readily from FIG. 2, the assembly 20 includes an open, rectangular top frame 22 which may be spot welded to a similar open, rectangular member 24 having an L-shaped cross section with a downwardly depending mounting flange 26. Flange 26 includes a plurality of apertures 28 for insertion of a corresponding number of mounting clips 30 during assembly of the unit. The mounting flange 26 extends from the top or cooking surface of ceramic sheet 12 downwardly beyond the bottom face of the ceramic sheet and around its perimeter as shown for instance most clearly in FIG. 4.

Figure 2:
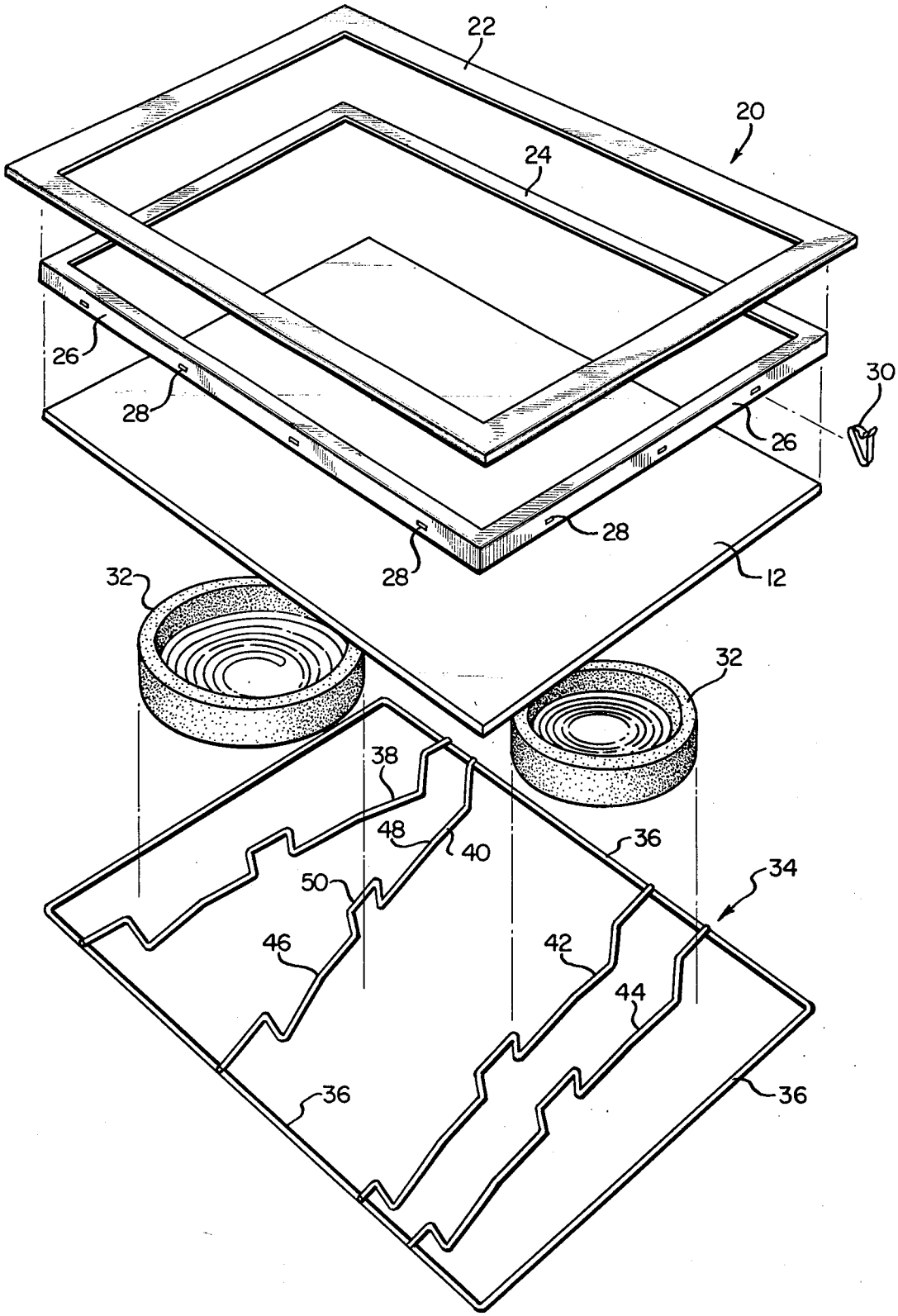
FIG. 2 is an exploded perspective view illustrating the lightweight wire frame and resilient wire members maintaining the electric heating elements in position beneath the range top cooking surface.

On the bottom surface 13 of the ceramic element forming cooking surface 12, a plurality of two different sized heating elements 32 are rigidly maintained in position by a lightweight wire frame 34. As shown in FIG. 2, the wire frame 34 is an open, rectangular form with a rectangular perimeter portion 36. Between two opposite sides of the perimeter portion 36 there is mounted paired resilient wire members 38, 40 and 42, 44. The ends of each wire member may be spot welded or otherwise rigidly attached to the opposing sides of the perimeter portion 36. As shown most clearly in FIGS. 2 and 4, each of the resilient wire members comprises an undulating wire form with two resilient sections between the rigid ends and an intermediate rigid portion. As an example, the wire member 40 is illustrated as including resilient sections 46, 48 extending from rigid attachment to the opposing side perimeter portions 36, and an intermediate rigid portion 50.

It is understood, of course, that each of the other resilient wire members 38, 42, 44 also includes two resilient sections such as wire sections 46, 48 of wire 40. The resilient section 46, 48 are under slight tension so that the heating element 32 resiliently urges the sections in a direction away from the cooking surface. Thus, the heating elements are each resiliently urged and maintained against the underside 13 of the cooking surface 12.

Figure 3:
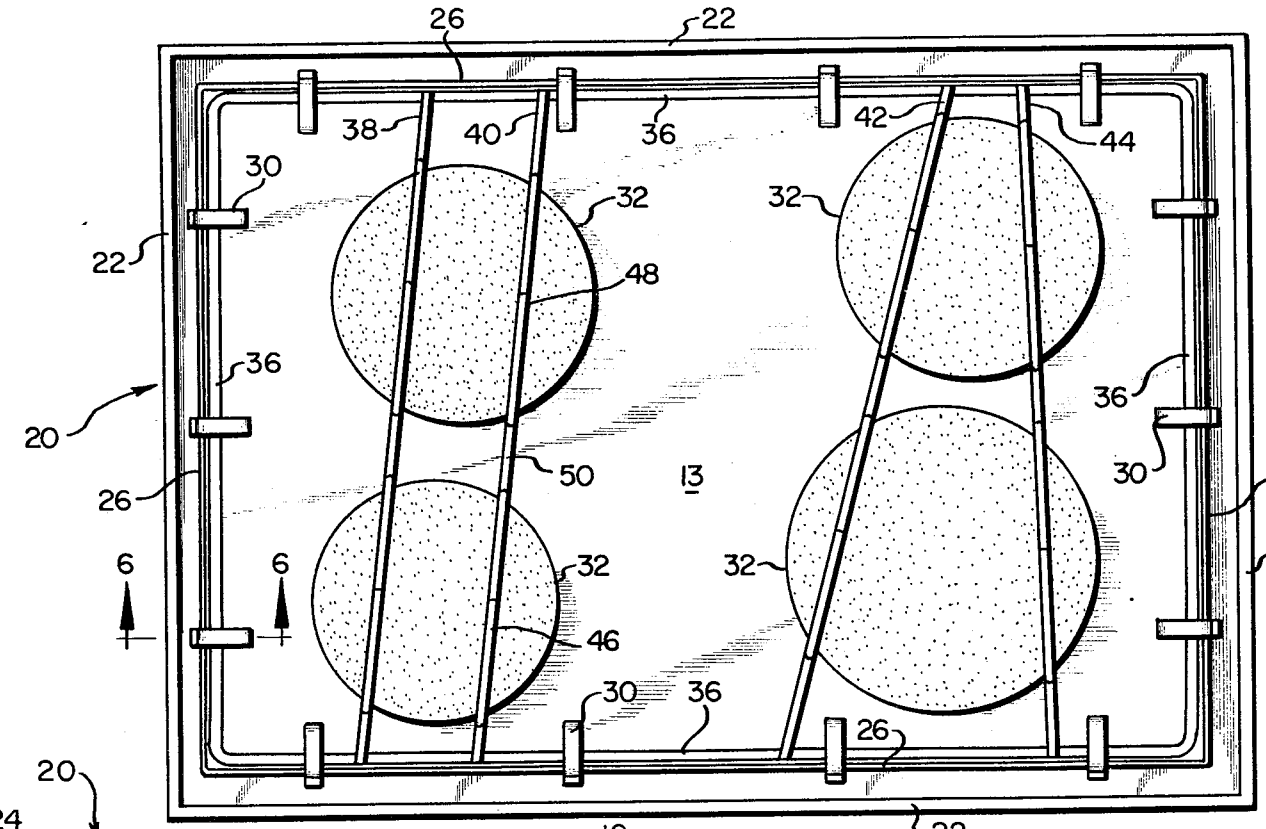
FIG. 3 is a bottom view of the assembled components of FIG. 2.
Figure 4:
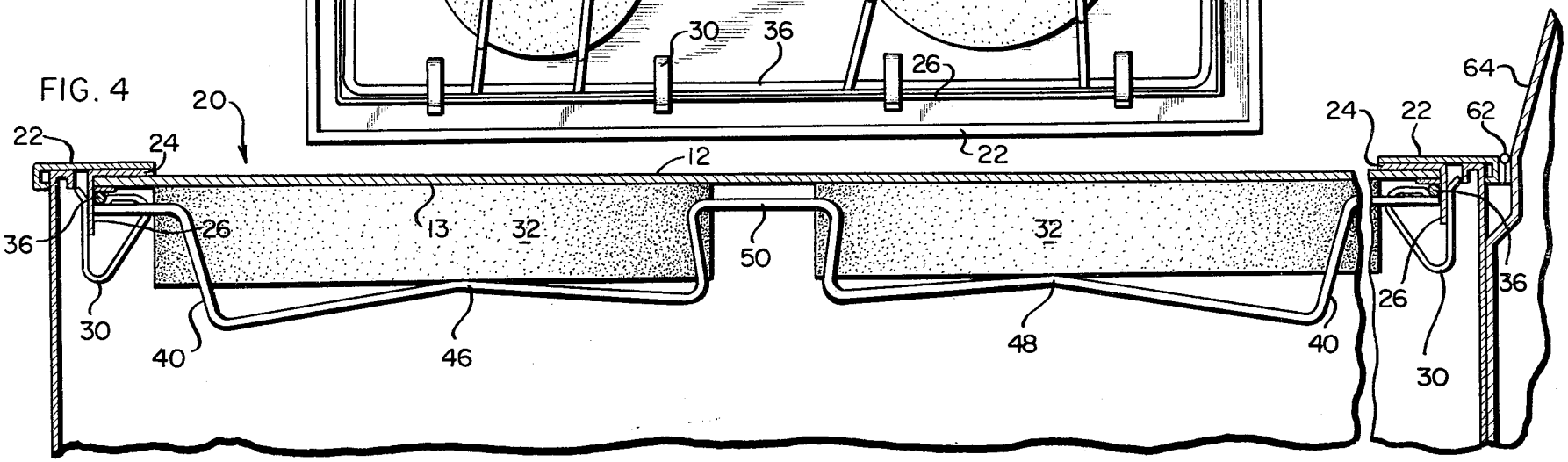
FIG. 4 is a fragmented, partial sectional view taken along the section lines 4—4 of FIG. 1 illustrating the preferred wireform embodiment of the present invention maintaining the heating elements directly beneath the range top cooking surface.

As noted in FIG. 3, the length of each resilient section such as the sections 46, 48 conforms to the size of the heating element 32 to enable a substantially parallel mounting position for the same size heating elements as illustrated by members 38, 40. When one of the heating elements is larger than the other, the resilient sections are the same but the wire members must be mounted skewed apart on the opposite perimeter portions 36 as shown by members 42, 44. In the event it is desired to have two regular and two large size heating elements, then wire members 38, 40 would also be skewed similar to that shown for members 42, 44 in FIG. 3.

In mounting the various components to form heater element assembly 20, the components are assembled in upside down fashion. Thus, the ceramic sheet is inserted within mounting flange 26 and onto the top frame 22 with cooking surface 12 being on the lower side and surface 13 being on the upper side. The heating elements 32 are then placed upside down in their respective locations on surface 13. The lightweight wire frame 34 is then placed upside down onto the other components with the resilient sections of each wire member resiliently engaging and urging the heater elements against surface 13. If desired, a narrow pad 52 may be placed around the perimeter the surface 13 to form a seat for the perimeter frame wire 36.

Figure 5:
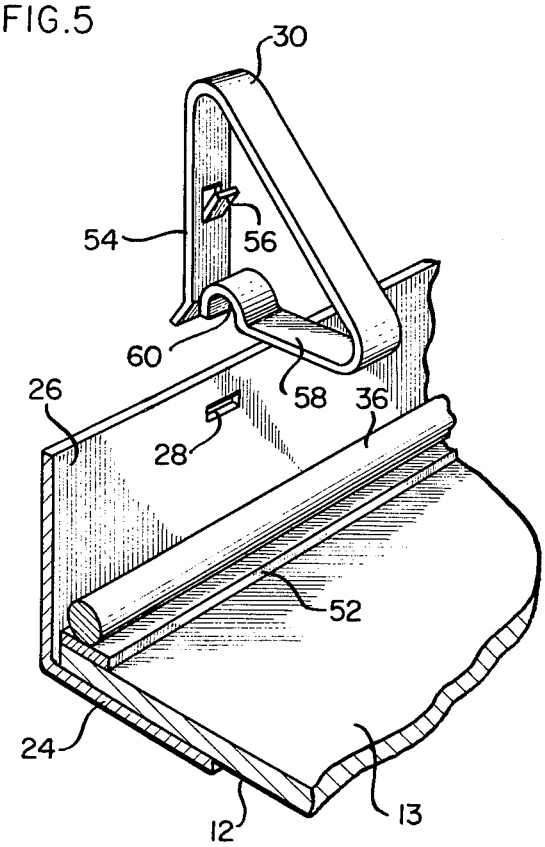
FIG. 5 is an expanded, perspective view illustrating one of the plurality of mounting clips for rigidly assembling the lightweight wire frame, heating elements and cooking surface to the range top frame.
Figure 6:
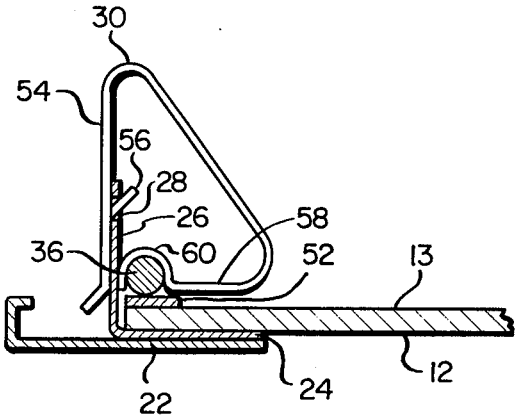
FIG. 6 is a partial sectional elevation view illustrating one of the mounting clips in position during the assembly of the preferred embodiment of the invention.

With reference to FIGS. 5 and 6, each of the plurality of clips 30 is formed of a generally open triangular shape with one leg 54 having a latch 56 and another leg 58 having a hook portion 60. Each of the clips can be readily mounted in position with leg 54 on one side of mounting flange 26 to enable the latch 56 to be inserted through aperture 28. Simultaneously, hook 60 extends over wire member 36, the hook end being shaped so as to conform to the shape of wire member 36. Each clip 30 is formed so that the unmounted distance between latch 56 and hook 60 is less than the distance between aperture 28 and member 36 to maintain the assembly components firmly in position.

After each of the clips 30 are positioned around the frame, the assembly 20 is mounted on range 10 by any suitable means, such as the hinge 62 joining frame 22 to a back frame member 64 of the electric range 10. Utilizing the present invention enables a significant reduction in parts from 52 total parts required by the prior art assembly to a total of only 23 parts in accordance with the present invention. In addition, a considerable amount of time is saved during the assembly procedure not only because of the reduction in parts, but also in the unique components of the present invention which enable a rather simple clipping together of the components without the need for screws, pot rivets, springs, support brackets, as needed in the prior art units.

Figure 7:
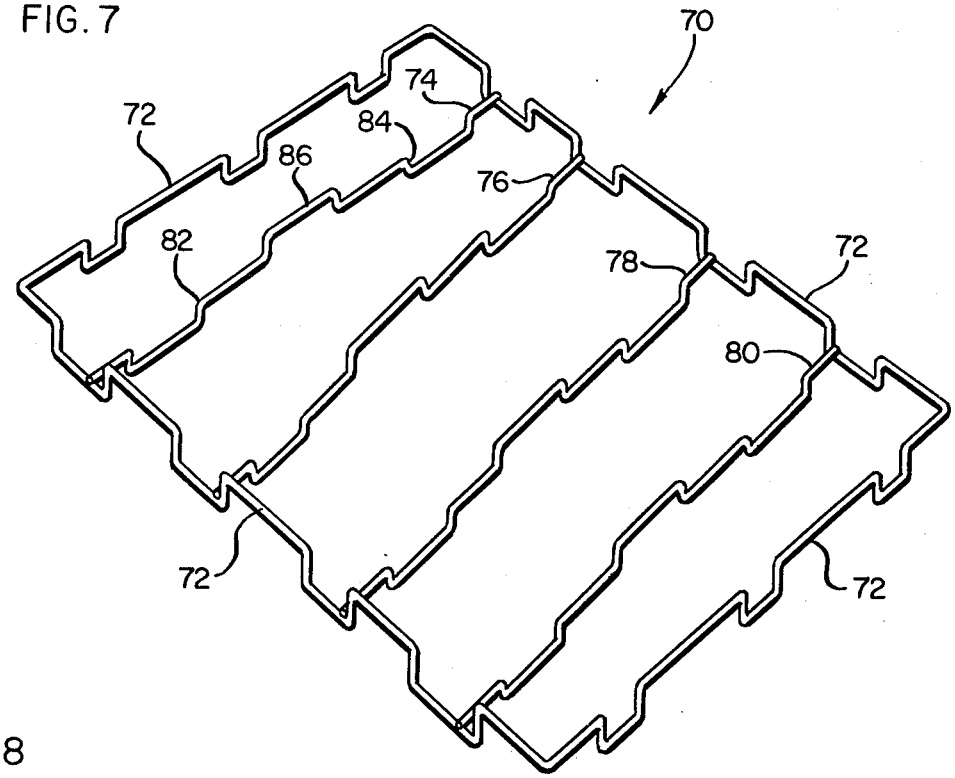
FIG. 7 is a perspective view illustrating another embodiment of the lightweight wireform member.
Figure 8:
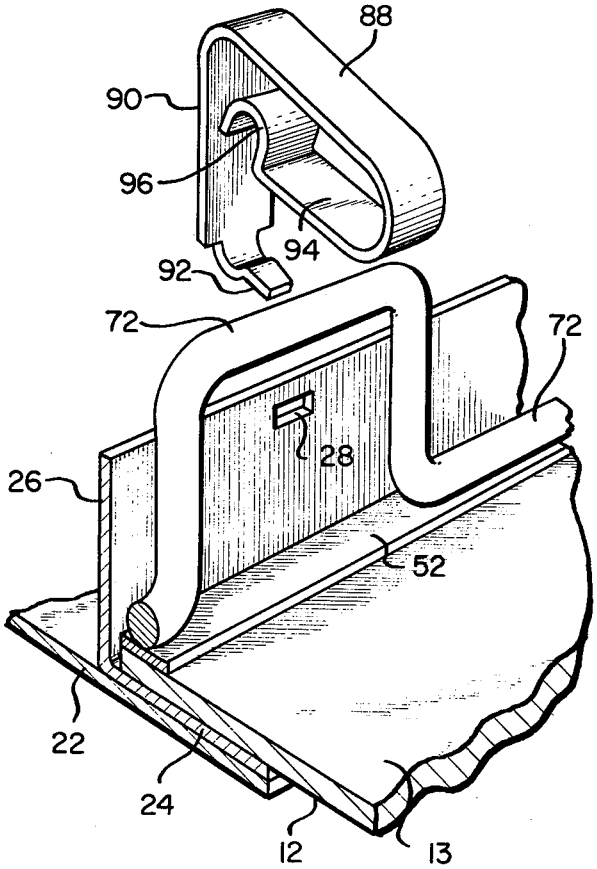
FIG. 8 is a partial perspective view illustrating one of the plurality of mounting clips provided for assembling the wireform, heating elements, and cooking surface to the range top frame in accordance with this embodiment of the invention.
Figure 9:
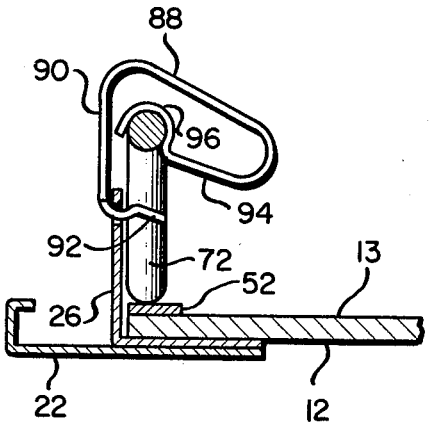
FIG. 9 is a partly sectional view showing one of the clips mounted in position corresponding to the detached clip position shown in FIG. 8.

FIGS. 7 through 9 illustrates another embodiment of the invention. A lightweight wire frame 70 includes an undulating perimeter wireform 72 and paired resilient wire members 74, 76 and 78, 80. The ends of each of the resilient members is spot welded or otherwise rigidly connected to opposite sides of the perimeter wire 72. As in the preferred embodiment of FIGS. 1–6, each of the resilient wireform members 74, 76 and 78, 80 includes two resilient sections such as the illustrated sections 82, 84 on either side of a substantially rigid portion 86.

With reference to FIGS. 8 and 9, it can be seen that components having the same reference numeral as in the corresponding FIGS. 5 and 6 remain the same in either embodiment. However, in this case the plurality of open, triangularly shaped clips 88 each includes one leg 90 with a latch 92 at one end and other leg 94 with a hook end 96. In this embodiment, each of the clips with leg 90 is placed on one side of mounting flange 26 to insert latch end 92 into and through mounting flange aperture 28. Simultaneously, hook end 96 hooks around the perimeter wire member 72 to maintain the frame in position. It is understood, of course, that the distance between aperture 28 and the top of perimeter wire member 72 is slightly greater than the unmounted distance between latch end 92 and hook 96 of the clips 88. Thus, when the clip is mounted in position, leg 94 is urged upwardly so that the clips resiliently maintain the frame 70 in position. Both of the embodiments illustrated herein provide a lighterweight heater element assembly having less parts and enabling more rapid assembly than prior art units.

While particular embodiments of the present invention have been shown and described, it will be obvious to those skilled in the art that various changes and modifications may be made without departing from the invention in its broader aspects. Accordingly, the aim of the appended claims is to cover all such changes and modifications as may fall within the true spirit and scope of the invention.

What is claimed is:

1. Apparatus for supporting electric range heating elements below a planar cooking surface on said range comprising:

a planar cooking surface;

a substantially rigid frame extending around the perimeter of one face of said planar cooking surface;

a mounting flange projecting from said frame at said perimeter from one face of said planar cooking surface to beyond the other face;

a wire frame extending around the perimeter of the other face of said planar cooking surface;

means for detachably mounting said wire frame to said mounting flange;

said wire frame including at least one pair of resilient wire members, each end of said resilient wire members mounted to a respective opposite side of said wire frame and extending therebetween across the other face of said cooking surface;

said resilient wire members including a resilient mounting portion resiliently capturing and urging a heating element between said wire members and said other face of said cooking surface.

2. Apparatus according to claim 1, wherein each pair of said reslient wire members includes a respective resilient mounting portion for a heating element with a substantially rigid portion therebetween.

3. Apparatus according to claim 1, wherein said wire frame includes another pair of said resilient wire members.

4. Apparatus according to claim 1, wherein said resilient wire members comprise an undulating wireform.

5. Apparatus according to claim 1, wherein said wire frame comprises an undulating wireform.

6. Apparatus according to claim 1, wherein said detachable mounting means includes a plurality of clips including means insertably mounting said clips to said mounting flange.

7. Apparatus according to claim 6, including a plurality of apertures in, and spacially separated around, said mounting flange, and wherein said clips include a latching end insertable through a respective aperture and another end depressingly engaging said wire frame.

8. Apparatus according to claim 7, wherein said other clip end comprises a hook conforming to the wire frame for clamping substantially around said wire frame.

9. In an electric range having a range top frame, a smooth, planar cooking surface below said range top frame, and electric heating elements, the improvement comprising:

a lightweight wire frame below said cooking surface including at least one pair of wire members extending across said wire frame;

said wire members each fixed at respective ends to said wire frame;

a resilient mounting portion formed in each wire member;

said paired wire members located so that said resilient mounting portions engage one of said heating elements to capture and resiliently urge said heating element immediately adjacent said planar cooking surface; and means for detachably mounting said lightweight wire frame to said range top frame.

10. The improvement of claim 9, wherein said wire members comprise an undulating wireform.

* * * * *